US008893448B2

(12) United States Patent
Wierzbowski et al.

(10) Patent No.: US 8,893,448 B2
(45) Date of Patent: Nov. 25, 2014

(54) EXPANSION JOINT SYSTEM FOR OPEN AIR STRUCTURES

(75) Inventors: Chris Wierzbowski, Cheektowaga, NY (US); Gary Moore, Orchard Park, NY (US)

(73) Assignee: Construction Research & Technology GmbH, Trostberg (DE)

( * ) Notice: Subject to any disclaimer, the term of this patent is extended or adjusted under 35 U.S.C. 154(b) by 232 days.

(21) Appl. No.: 13/216,821

(22) Filed: Aug. 24, 2011

(65) Prior Publication Data

US 2012/0047832 A1 Mar. 1, 2012

Related U.S. Application Data

(60) Provisional application No. 61/376,512, filed on Aug. 24, 2010.

(51) Int. Cl.

| | |
|---|---|
| ***E04F 15/22*** | (2006.01) |
| ***E04B 1/68*** | (2006.01) |
| ***E04F 11/16*** | (2006.01) |

(52) U.S. Cl.

CPC ..... *E04B 1/681* (2013.01); *E04B 1/6803* (2013.01); *E04F 11/16* (2013.01)

USPC ..... 52/396.08; 52/6; 52/573.1; 52/393; 52/186

(58) Field of Classification Search

CPC ..... A47C 1/12; A47C 7/407; E04H 3/12; E04H 3/126; E04H 15/38; E04B 1/344; E04C 2/405; E04C 2002/004

USPC ..... 52/393, 394, 396.04, 396.08, 182, 183, 52/184, 186, 6, 7, 573.1; 14/71.1, 69.5; 16/20, 35 R, 44; 403/28, 29, 30

See application file for complete search history.

(56) References Cited

U.S. PATENT DOCUMENTS

| | | | | |
|---|---|---|---|---|
| 3,448,552 | A | 6/1969 | Schmitt et al. | |
| 3,975,872 | A * | 8/1976 | Pinero | 52/71 |

(Continued)

FOREIGN PATENT DOCUMENTS

| | | | | |
|---|---|---|---|---|
| CN | 200 964 634 | Y | 10/2007 | |
| EP | 0 711 880 | A2 | 5/1996 | |
| JP | 10-46684 | | 2/1998 | |
| JP | 10046684 | A * | 2/1998 | E04N 1/62 |

OTHER PUBLICATIONS

PCT/EP2011/064267—International Search Report, Oct. 27, 2011.

(Continued)

*Primary Examiner* — Joshua J Michener
*Assistant Examiner* — Matthew Gitlin
(74) *Attorney, Agent, or Firm* — Curatolo Sidoti Co., LPA; Salvatore A. Sidoti; Daniel E. Moderick, Jr.

(57) ABSTRACT

An expansion joint system for bridging an expansion joint gap between two spaced-apart underlying stair structures. The expansion joint system includes a movable plate that is connected to a fixed plate through a hinge. The hinge connection permits the movable plate to move in response to thermal movements and seismic events that causes the width of the expansion joint to open to a greater width or close to a smaller width. Following the seismic or thermal event, the hinge connection automatically returns the movable plate to its original position.

23 Claims, 4 Drawing Sheets

(56) References Cited

U.S. PATENT DOCUMENTS

| | | | | | |
|---|---|---|---|---|---|
| 4,071,994 | A * | 2/1978 | Ammann | 52/393 |
| 4,073,673 | A * | 2/1978 | Raabe et al. | 156/244.12 |
| 4,557,082 | A * | 12/1985 | Dunsworth | 52/109 |
| 5,058,350 | A | 10/1991 | Mochiki et al. | |
| 5,595,233 | A * | 1/1997 | Gower | 160/232 |
| 5,715,574 | A * | 2/1998 | Schall | 16/301 |
| 5,887,400 | A * | 3/1999 | Bratek et al. | 52/396.03 |
| 6,022,169 | A * | 2/2000 | Kim et al. | 404/52 |
| 6,079,072 | A * | 6/2000 | Katsiri | 14/2.4 |
| 6,115,973 | A * | 9/2000 | Goto | 52/167.4 |
| 6,125,596 | A * | 10/2000 | Goto | 52/167.4 |
| 6,202,355 | B1 * | 3/2001 | Uram et al. | 52/5 |
| 6,292,968 | B1 * | 9/2001 | McLain | 14/71.1 |
| 6,364,374 | B1 * | 4/2002 | Noone et al. | 285/424 |
| 6,460,214 | B1 * | 10/2002 | Chang | 14/73.1 |
| 6,581,347 | B1 * | 6/2003 | Knak et al. | 52/396.04 |
| 6,609,339 | B1 * | 8/2003 | Pardue | 52/235 |
| 6,962,026 | B2 * | 11/2005 | Knak et al. | 52/396.04 |
| 6,968,652 | B1 * | 11/2005 | Eadie | 52/71 |
| 7,389,555 | B2 * | 6/2008 | Xu et al. | 14/73.1 |
| 7,484,259 | B2 * | 2/2009 | Xu et al. | 14/73.1 |
| 7,887,249 | B2 * | 2/2011 | Schmitz | 403/364 |
| 8,671,521 | B2 * | 3/2014 | Irwin | 16/308 |
| 2002/0157326 | A1 * | 10/2002 | Zwanenburg | 52/71 |
| 2003/0154677 | A1 * | 8/2003 | Knak et al. | 52/396.04 |
| 2005/0241084 | A1 * | 11/2005 | Delis | 14/73.5 |
| 2006/0021164 | A1 * | 2/2006 | Mitchell et al. | 14/71.1 |
| 2010/0205776 | A1 * | 8/2010 | Burks | 16/343 |
| 2011/0030170 | A1 * | 2/2011 | Heaven | 16/277 |
| 2012/0174497 | A1 * | 7/2012 | Kroes | 52/71 |
| 2012/0246876 | A1 * | 10/2012 | Burks | 16/375 |

OTHER PUBLICATIONS

PCT/EP2011/064267—Written Opinion of the International Searching Authority, Oct. 27, 2011.

* cited by examiner

EXPANSION JOINT SYSTEM FOR OPEN AIR STRUCTURES

This application claims the benefit of the filing date under 35 U.S.C. 119(e) from U.S. Provisional Application For Patent Ser. No. 61/376,512, filed Aug. 24, 2010, which is hereby incorporated by reference.

TECHNICAL FIELD

Disclosed is an expansion joint system for bridging a gap that is located between spaced-apart structural members.

BACKGROUND

An opening or gap is purposely provided between adjacent concrete structures for accommodating dimensional changes within the gap occurring as expansion and contraction due to temperature changes, changes in concrete structure dimensions, and seismic cycling and vibration. An expansion joint control system is conventionally installed in the gap to provide a bridge across the gap and to accommodate the movements occurring in the vicinity of the gap.

Expansion joint control systems are often used in open air structures, such as stadiums. The tread and riser applications in stadiums require the expansion joint control system to accommodate multi-directional movement resulting from seismic and thermal events, while still permitting egress across the expansion joint gap in the event of an seismic or thermal event during the sporting or entertainment event.

SUMMARY

According to certain illustrative embodiments, provided is an expansion joint system comprising a first plate adapted to be fixedly attached to an underlying structural member, and a second plate movably attached to the first plate and adapted to be movably engaged to an underlying structural member, wherein the first plate it attached to the second plate by a self closing hinge.

According to further illustrative embodiments, provided is an expansion joint comprising two spaced-apart underlying structural members, a first plate adapted to be fixedly attached to a first underlying structural member, and a second plate movably attached to the first plate and movably engaged to a second underlying structural member, wherein the first plate it attached to the second plate by a self closing hinge.

DETAILED DESCRIPTION

Figure 1:
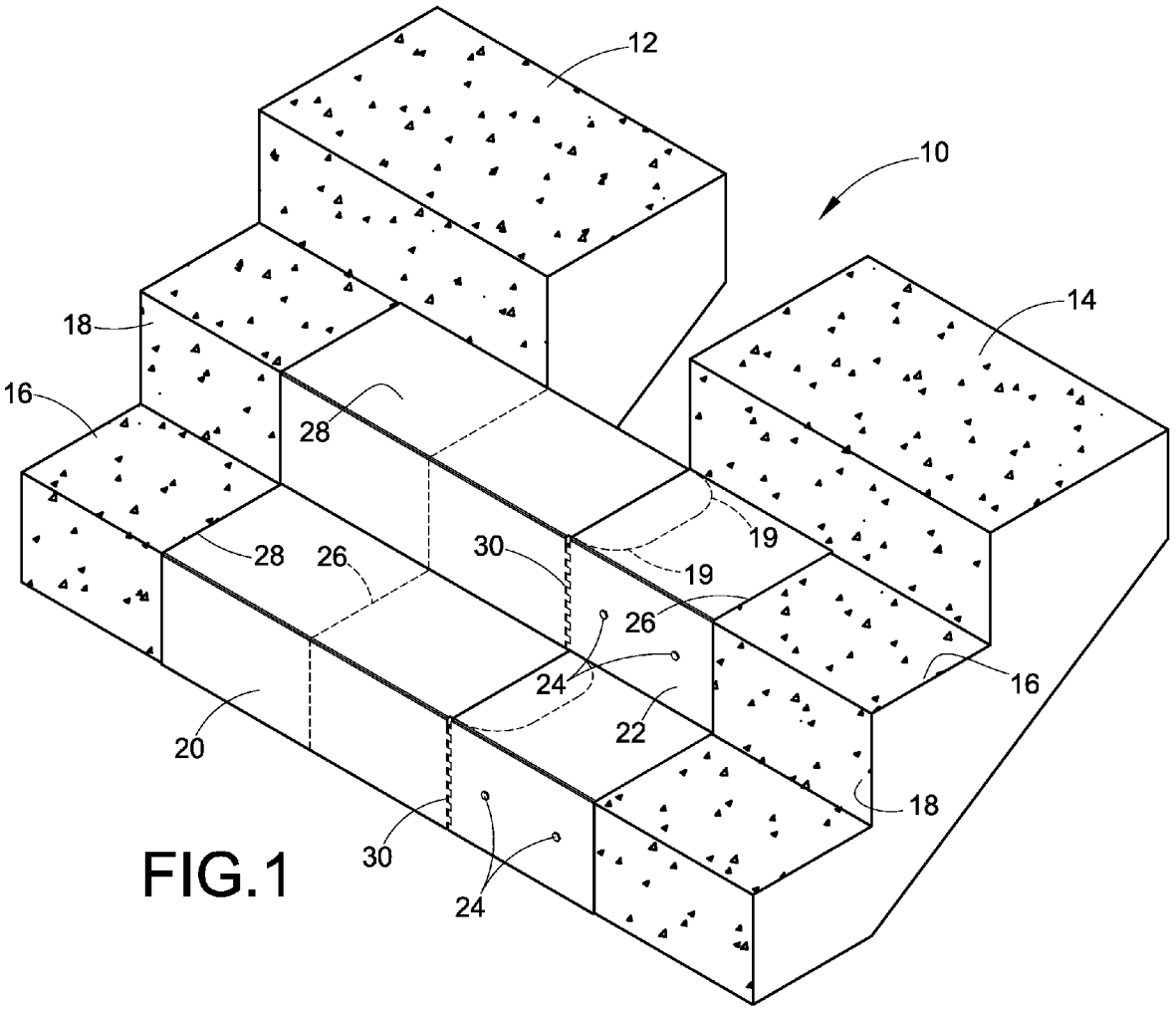
FIG. 1 is a perspective view of a first illustrative embodiment of the expansion joint system.

The expansion joint system includes a plate that is fixedly attached to an underlying structural member. A further plate is movably attached to the fixed plate through a self-closing hinge. Because the movable plate is attached to the fixed plate through the self closing hinge, the movable plate can move out of its normal position in response to a seismic or thermal event and can automatically return to its normal position following the event.

An expansion joint including the expansion joint control system is also disclosed. The expansion joint comprises two spaced-apart underlying structural members. A first plate is fixedly attached to one of the two underlying structural members. A second plate is movably attached to the first plate and movably engaged to the other of the two spaced-apart underlying structural members. The first plate is attached to the second plate by a self closing hinge mechanism to permit the movable plate to move out of its normal position in response to a seismic or thermal event and can automatically return to its normal position following the event.

A self-closing hinge is a type of hinge that is commonly used to pull a door shut after it has been opened and released. The self-closing hinge generally comprises two pieces of metal that are joined by a pin to permit the two pieces of metal to rotate away from each other so that movable plate can move during a seismic or thermal event. The self-closing hinge is spring mounted, so that the spring will pull the hinge back together again and close the movable plate of the expansion joint control system following a seismic or thermal event.

The first and second plates of the expansion joint control system may be bent into a substantially 90° angle. One portion of each of the first and second plates is adapted to be placed in contact with the tread portion of the tread riser condition and the other portion of the bent plates is adapted to be placed into adjacent contact with the riser portion of the tread and riser condition. The portion of the moveable plate that is adapted for adjacent contact with the tread portion of the tread and riser condition includes edges that are radiused (ie, the corner edges are rounded or curved) to permit shearing movement without binding. The radiused edges of the movable plate permits the plate to slide out of the neutral position during the event and return to the neutral position following the event without colliding with the underlying structural members or the plate that is fixedly attached to the underlying structural member.

The expansion joint control system can accommodate multi-directional movement while still permitting egress across the expansion joint gap. The expansion joint control system can move freely in both thermal and lateral shear movements along the tread and riser condition without the expansion joint control system suffering any structural deformity. The spring loaded hinge also eliminates the need for a worker from walking all of the expansion joint lines and manually returning the cover plates to proper position following a seismic event.

Certain illustrative embodiments of the expansion joint system will now be described in greater detail with reference to the FIGURES. It should be noted that the expansion joint system is not intended to be limited to the illustrative embodiments shown in the FIGURES, but shall include all variations and modifications within the scope of the claims.

FIG. 1 depicts a first illustrative embodiment of the expansion joint system installed across an expansion joint. The expansion joint 10 comprises two spaced-apart structural members 12, 14. Each of the underlying structural members are comprised of a plurality of stair structures comprising a tread portion 16 and a riser portion 18. Expansion joint system 20 includes a first plate 22 that is fixedly attached to an underlying stair structure 14. The first plate 22 is bent into a substantially 90° angle. The first plate 22 is fixed attached to the riser portion 18 of the structure 14 through mechanical fasteners 24. The lateral edge of first plate 22 includes a beveled edge 26 to permit a smooth transition from stair structure 14 across first plate 22. Without limitation, and only by way of illustration, the beveled edge 26 may comprise a polymeric material, such a urethane material. Still referring to FIG. 1, the expansion joint system includes a second plate 28 that is movably attached to the first fixedly attached plate 22. Second plate 28 is movably attached to the first plate 22 through a hinge 30. A portion of fixedly attached plate 22 overlaps the top surface of movably attached plate 28. The movable plate 28 is provided with radiused corners 19 to permit shear movement. The embodiment shown in FIG. 1 is directed to an illustrative embodiment of the expansion joint system where all of the fixedly attached plates 22 are fixedly attached to one of the underlying structural members 14.

Figure 2:
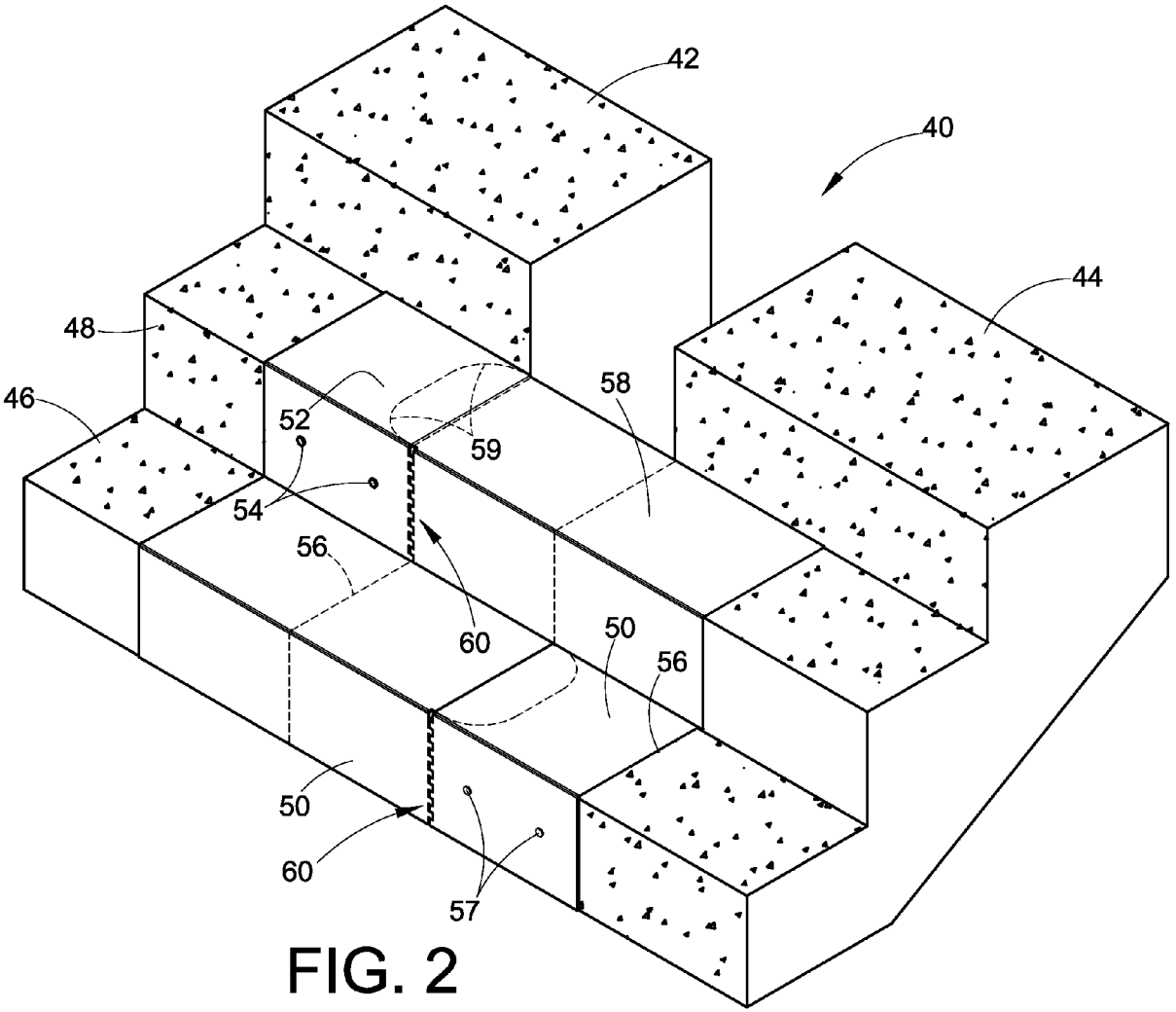
FIG. 2 is a perspective view of a second illustrative embodiment of the expansion joint system.

FIG. 2 depicts a second illustrative embodiment of the expansion joint system installed across an expansion joint. The expansion joint 40 comprises two spaced-apart structural members 42, 44. Each of the underlying structural members are comprised of a plurality of stair structures comprising a tread portion 46 and a riser portion 48. Expansion joint system 50 includes a first plate 52 that is fixedly attached to an underlying stair structure 42. The first plate 52 is bent into a substantially 90° angle. The first plate 52 is fixed attached to the riser portion 48 of the structure 42 through mechanical fasteners 54. The lateral edge of first plate 52 includes a beveled edge 56 to permit a smooth transition from stair structure 42 across first plate 52. Still referring to FIG. 2, the expansion joint system includes a second plate 58 that is movably attached to the first fixedly attached plate 52. Second plate 58 is movably attached to the first plate 52 through a hinge 60 and attached to structural member 44 through mechanical fasteners 57. A portion of fixedly attached plate 52 overlaps the top surface of movably attached plate 58. The movable plate 58 is provided with radiused corners 59 to permit shear movement. According to the illustrative embodiment shown in FIG. 2, the fixedly attached plate 52 is attached to the opposite riser portion 48 of the immediate lower adjacent stair structure 44.

Figure 3:
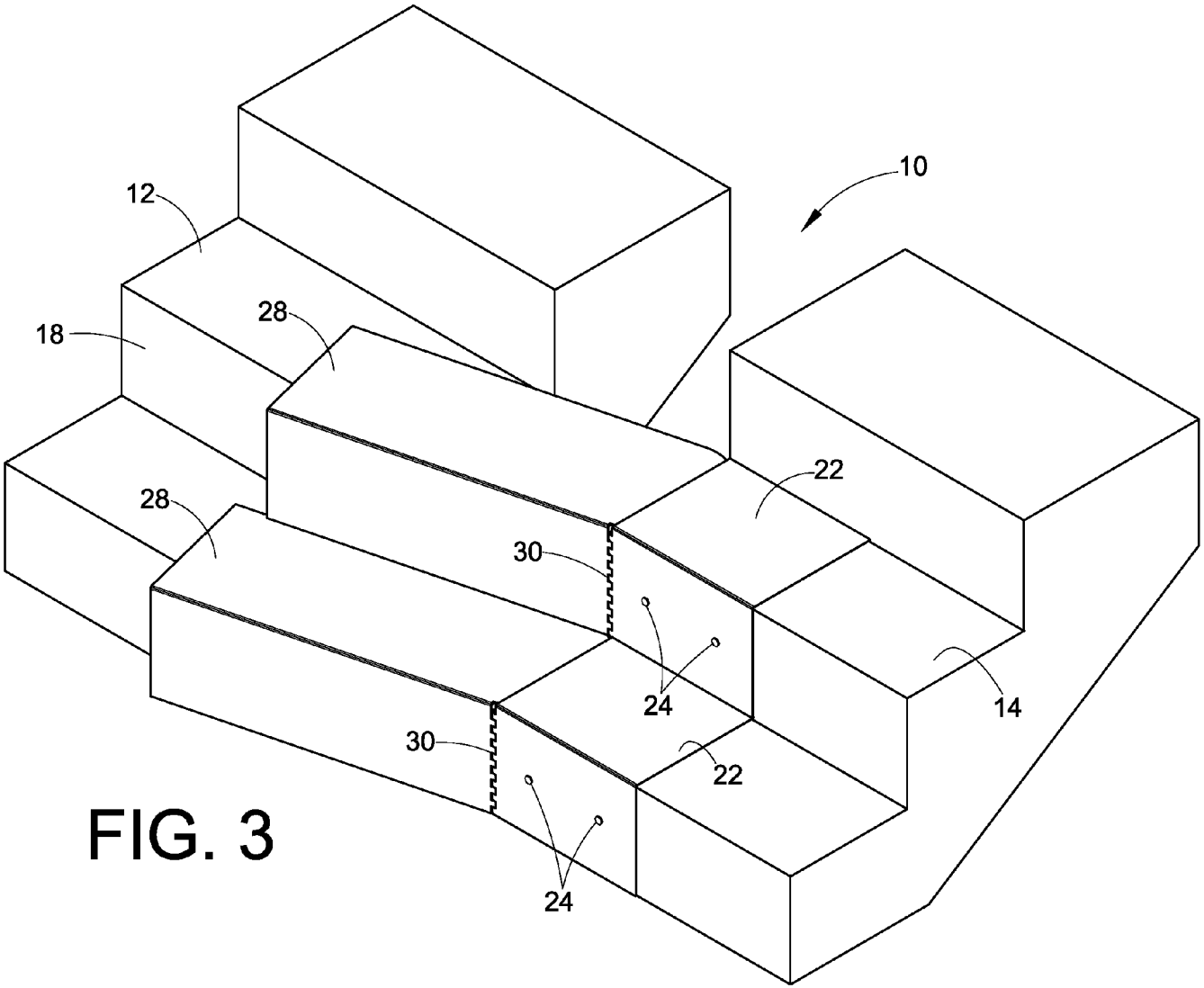
FIG. 3 is a perspective view of the first illustrative embodiment of the expansion joint system under the conditions where the expansion joint gap has opened to a greater width and the adjacent concrete structures have moved relative to each other in plane in response to a seismic or thermal event.

FIG. 3 depicts the illustrative embodiment of FIG. 1 in a condition where the expansion joint gap 10 located between the two spaced-apart underlying structural members 12, 14 has opened to a maximum designed width and, in addition, structural sections 12 and 14 have moved relative to each other parallel to a horizontal plane. In the condition where the expansion joint gap 10 has moved in two principle directions simultaneously, the spring-loaded hinge opens and the movably attached plate 28 slides away from fixedly attached plate 22 and underlying structural member 12 to accommodate the change in gap width due to thermal and/or seismic events. Fixed attached plate 22 is attached to structural member 14 through mechanical fasteners 24. Following a thermal and/or seismic event that opens the gap 10, the spring-loaded hinge 30 automatically closes and returns the slidable plate 28 to its original position adjacent the outwardly facing surface of riser 18.

Figure 4:
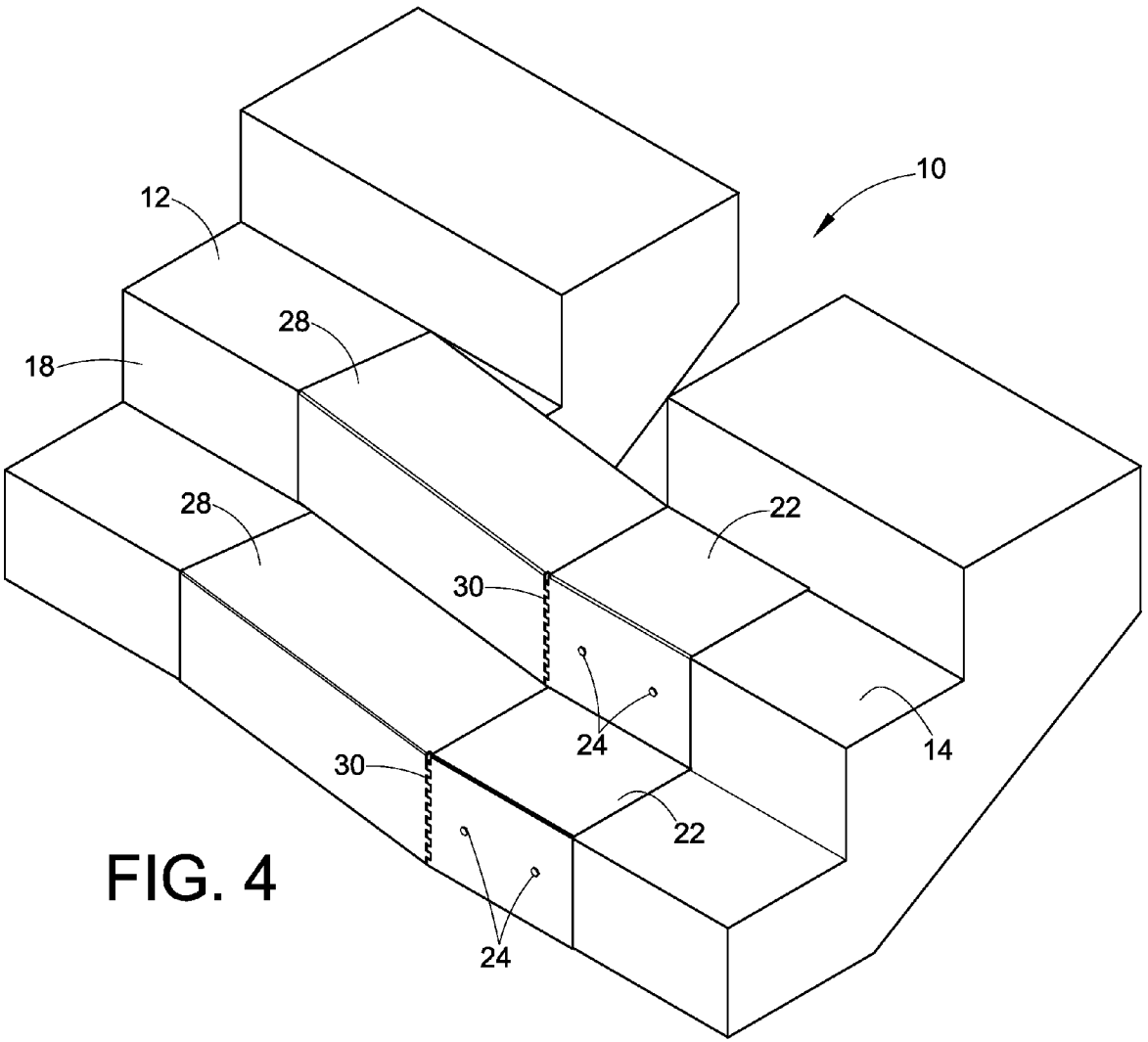
FIG. 4 is a perspective view of the first illustrative embodiment of the expansion joint system under the conditions where the expansion joint gap has closed to a smaller width and the adjacent concrete structures have moved relative to each other in plane in response to a seismic or thermal event.

FIG. 4 depicts the illustrative embodiment of FIG. 1 in a condition where the expansion joint gap 10 located between the two spaced-apart underlying structural members 12, 14 has closed to a width that is less than its nominal designed width and, in addition, structural sections 12 and 14 have moved relative to each other parallel to a horizontal plane. In the condition where the expansion joint gap 10 has moved in two principle directions simultaneously, the spring-loaded hinge closes and the movably attached plate 28 moves with the underlying structural member 12 to accommodate the change in gap 10 width due to thermal and/or seismic events. Fixed attached plate 22 is attached to structural member 14 through mechanical fasteners 24. Following a thermal and/or seismic event that closes the gap 10, the spring-loaded hinge 30 automatically opens and returns the slidable plate 28 to its original position adjacent the outwardly facing surface of riser 18.

The present expansion joint control system also accommodates relative out of plane movements of the spaced-apart structural members 12, 14 that occur in response to seismic events. Without limitation, the expansion joint control system can accommodate out of plane movements which result in the forward or rearward displacement of spaced-apart structural members 12, 14 relative to each other.

While the expansion joint system has been described above in connection with the certain illustrative embodiments, as shown in the various Figures, it is to be understood that other similar embodiments may be used or modifications and additions may be made to the described embodiments for performing the same function of the expansion joint system without deviating therefrom. Further, all embodiments disclosed are not necessarily in the alternative, as various embodiments may be combined to provide the desired characteristics. Variations can be made by one having ordinary skill in the art without departing from the spirit and scope of the disclosure.

The invention claimed is:

1. An expansion joint system comprising:

a first plate fixedly attached to an underlying structural member; and a second plate movably attached to the first plate and slidably engaged to an underlying structural member;

wherein the first plate is directly attached to the second plate by a self closing hinge, and a portion of the first plate overlaps a portion of the second plate when the system is in a neutral position.

2. The expansion joint system of claim 1, wherein edges of the second plate are radiused.

3. The expansion joint system of claim 1, wherein the first and second plates are bent in a substantially 90° angle.

4. The expansion joint system of claim 1, wherein the first plate further comprises at least one beveled edge.

5. The expansion joint system of claim 4, wherein the beveled edge comprises a polymeric material support.

6. The expansion joint system of claim 5, wherein the polymeric material support comprises a polyurethane.

7. The expansion joint system of claim 1, wherein surfaces of the first and second plates further comprise a slip reducing coating.

8. An expansion joint comprising:

a stair structure comprising spaced-apart first and second underlying tread-riser portions;

a first plate fixedly attached to said first underlying tread-riser portion;

a second plate movably attached to the first plate and movably engaged with a second underlying tread-riser portion;

wherein the first plate is attached to the second plate by a self closing hinge.

9. The expansion joint of claim 8, wherein a portion of the first plate overlaps a portion of the second plate when the joint is in a neutral position.

10. The expansion joint of claim 8, wherein edges of the second plate are radiused.

11. The expansion joint of claim 8, wherein the first and second plates are bent in a substantially 90° angle.

12. The expansion joint of claim 8, wherein the first plate further comprises at least one beveled edge.

13. The expansion joint of claim 12, wherein the beveled edge comprises a polymeric material support.

14. The expansion joint of claim 13, wherein the polymeric material support comprises a polyurethane.

15. The expansion joint of claim 8, wherein surfaces of the first and second plates further comprise a slip reducing coating.

16. The expansion joint of claim 8, wherein the first plate is directly attached to the second plate.

17. An expansion joint system comprising:

a first plate fixedly attached to an underlying structural member; and a second plate movably attached to the first plate and slidably engaged to an underlying structural member;

wherein the first plate is attached to the second plate by a self closing hinge, wherein the self closing hinge comprises two pieces of metal that are joined by a pin and a spring mount; and wherein a portion of the first plate overlaps a portion of the second plate when the system is in a neutral position.

18. The expansion joint system of claim 17, wherein edges of the second plate are radiused.

19. The expansion joint system of claim 17, wherein the first and second plates are bent in a substantially 90° angle.

20. The expansion joint system of claim 17, wherein the first plate further comprises at least one beveled edge.

21. The expansion joint system of claim 20, wherein the beveled edge comprises a polymeric material support.

22. The expansion joint system of claim 21, wherein the polymeric material support comprises a polyurethane.

23. The expansion joint system of claim 17, wherein surfaces of the first and second plates further comprise a slip reducing coating.

* * * * *